US006407034B1

(12) United States Patent
Ewing

(10) Patent No.: US 6,407,034 B1
(45) Date of Patent: Jun. 18, 2002

(54) THERMAL CHROMOGENIC PLASTIC FILM AND METHOD OF MANUFACTURE THEREFOR

(76) Inventor: William D. Ewing, P.O. Box 223, Tiberton, RI (US) 02878

( * ) Notice: Subject to any disclaimer, the term of this patent is extended or adjusted under 35 U.S.C. 154(b) by 0 days.

(21) Appl. No.: 09/394,674

(22) Filed: Sep. 13, 1999

(51) Int. Cl.[7] ..... B41M 5/30

(52) U.S. Cl. ..... 503/200; 425/381.2; 503/216; 503/217

(58) Field of Search ..... 503/200, 216, 503/217; 425/381.2

(56) References Cited

U.S. PATENT DOCUMENTS

| | | | | |
|---|---|---|---|---|
| 3,867,179 A | | 2/1975 | Page | |
| 4,325,850 A | | 4/1982 | Mueller et al. | 524/228 |
| 4,470,057 A | | 9/1984 | Glanz | |
| 4,520,379 A | | 5/1985 | Glanz et al. | |
| 4,652,409 A | | 3/1987 | Leese et al. | 264/22 |
| 4,717,710 A | * | 1/1988 | Shimizo | 503/213 |
| 5,229,218 A | | 7/1993 | Dobreski et al. | 428/516 |
| 5,268,074 A | | 12/1993 | Brooks et al. | 162/4 |
| 5,474,968 A | | 12/1995 | Norimatsu | 503/226 |
| 5,514,635 A | * | 5/1996 | Filo | 503/200 |

FOREIGN PATENT DOCUMENTS

| | | |
|---|---|---|
| JP | 04112078 | * 4/1992 |
| JP | 09302236 | * 11/1997 |

* cited by examiner

*Primary Examiner*—Bruce H. Hess
(74) *Attorney, Agent, or Firm*—Larson & Taylor, PLC

(57) ABSTRACT

A thermally printable thermoplastic media includes a thermoplastic material having a thermally activated composition incorporated therein. The thermally activated composition includes a leuco-dye, a color developer, and a reaction promoter. The printable media preferably has a thickness of from about 0.5 to about 1.5 mils to provide a roll with a longer length than a conventional paper roll, thereby increasing the amount of printable media which can be contained on a roll. The thermally printable thermoplastic media is manufactured by combining a thermoplastic material and a thermally activated composition, melting the combined thermoplastic material and thermally activated composition and forming a film from the combined thermoplastic material and thermally activated composition, typically by extrusion. To prevent pre-imaging or initiation of a thermochromogenic reaction from the heat involved in extrusion, the extrusion is preferably carried out in an oxygen-free environment.

18 Claims, No Drawings

THERMAL CHROMOGENIC PLASTIC FILM AND METHOD OF MANUFACTURE THEREFOR

BACKGROUND OF THE INVENTION

1. Field of the Invention

The present invention relates to a thermally printable thermoplastic media and, more particularly, to a thermoplastic material having a leuco-dye, color developer, and a reaction promoter incorporated therein.

2. Description of the Related Art

Since the 1960's, direct thermal coatings have been applied to paper substrates to produce a receptive media for direct thermal printing. Early applications included meat market marking scales and facsimile machines. Today plain paper faxes are replacing direct thermal printing fax machines, but thermal printing is still dominant in point of purchase receipt printers, scale and variable information label applications, and growing in medical, photo and gaming applications.

Thermal printing processes typically utilize paper which is coated on one surface with a thermal-chromogenic layer comprising a leuco-dye, a color developer and a reaction promoter. Images are formed in the thermal-chromogenic layer by thermal print heads which heat the coated paper to a temperature of 160 to 200 F in selected areas under standard atmospheric conditions. The color developer, when heated, reacts with the leuco-dye to develop a color from the dyes in the thermal-chromogenic layer. This, in turn, causes the formation of images corresponding to the selected areas, i.e., dots generated by the thermal print heads, which are visible against the background color defined by the colored layer.

Typically, paper companies manufacture thermally printable media. However, there is a growing movement and need to replace paper with plastics in several applications. One such application is point of purchase printed sales receipts, such as those printed in grocery stores. Printed receipts are usually handed to a customer and/or in many cases placed in a shopping bag with purchased products. Many retail stores utilize plastic bags and efforts to collect and recycle these bags are becoming widespread. Plastic shopping bags are usually recycled by shredding the bags and re-extruding the shredded bags into pellets to make thick film for disposable trash bags and the like. Paper fiber created by paper receipts left in plastic shopping bags is a serious problem for recyclers since it clogs the screens in the extruder and causes holes to form in the subsequent film-making process.

The need and desire to replace paper with plastics has created a need for a thermally printable plastic material. Currently, thermally printable plastic material is produced using the same methods used for thermally printable paper media, i.e., by coating a plastic support sheet with a thermal-chromogenic layer. However, it is both inefficient and costly for paper companies to apply thermal coatings to plastics.

SUMMARY OF THE INVENTION

According to a first aspect of the invention, a thermally printable thermoplastic media comprises a thermoplastic material having a thermally activated composition incorporated therein. The thermally activated composition includes a leuco-dye, a color developer, and a reaction promoter. The thermoplastic material may also contain binders and/or fillers. Advantageously, the printable media has a thickness of from about 0.5 to about 1.5 mils to provide a roll with a longer length than a conventional paper roll, thereby increasing the amount of printable media which can be contained on a roll. However, the media may be made thicker for photo and medical applications.

According to a second aspect of the invention a thermally printable thermoplastic media is manufactured by combining a thermoplastic material and a thermally activated composition, melting the combined thermoplastic material and thermally activated composition and forming a film from the combined thermoplastic material and thermally activated composition, typically by extrusion. To prevent pre-imaging or initiation of a thermo-chromogenic reaction from the heat involved in extrusion, the extrusion is preferably carried out in an oxygen-free environment.

DETAILED DESCRIPTION OF THE PREFERRED EMBODIMENTS

According to the present invention, a thermally printable thermoplastic media includes a thermoplastic material having a thermally activated composition incorporated therein. As used herein, the term "incorporated therein" shall mean the thermally activated composition is interspersed in the thermoplastic material during the manufacturing process.

The thermoplastic material is preferably polyethylene, as this is the material from which grocery bags are typically manufactured. However, polypropylene and polystyrene, as well as any of the polymers or mixtures thereof identified in U.S. Pat. No. 5,229,218, the disclosure of which is herein incorporate by reference, or any other films capable of receiving printing thereon, may be utilized. A variety of different polyethylene materials can be employed for fabricating the media of the present invention including high density polyethylene (HDPE), medium density polyethylene (MDPE), and linear low density polyethylene (LLDPE), among others. The preferred polyethylene material for use in fabricating the thermally printable media of the present invention is high-density polyethylene. More preferably, high molecular weight high-density polyethylene is employed since the properties of this material appear to be most suitable for the application as a printable media.

The thermally activated composition of the invention includes a leuco-dye, a color developer, a reaction promoter and, optionally, binders and/or fillers. Leuco-dyes are compounds that exhibit color in an oxidized state, but are water-insoluble. Leuco-dyes are water-soluble in reduced form but are also colorless. The leuco-dyes suitable for use in the thermally activated composition include triphenylmethane dyes, fluoran dyes, phenothiazine dyes, rhodamine lactam dyes, and spiropyran dyes. The preferred class of leuco-dye is triphenylmethane dye. Typically, the triphenylmethane dye utilized is crystal violet lactone, although any of the leuco-dyes identified in U.S. Pat. No. 5,474,968, the disclosure of which is herein incorporated by reference, may be employed.

The color developer is typically a phenolic compound that liquefies or gasifies at temperatures higher than room temperature, in order to react with the leuco-dye and thereby develop a color. Preferably, the color developer is bisphenol A, however, any of the color developers disclosed in U.S. Pat. No. 5,474,968 may be utilized.

The reaction promoter is preferably stearic acid amide, oleic acid amide, palmitic acid amide, sperm-whale oleic acid amide or coconut acid amide.

The thermally printable thermoplastic media of the present invention can be fabricated using conventional processes for the production of thermoplastic polymeric films in an oxygen-free environment. These conventional processes include extrusion, blowing or casting technology. Since extrusion temperatures far exceed the initiation temperature of the thermo-chromogenic reaction, the extrusion must be carried out in the absence of oxygen to prevent premature initiation of the reaction. Thus, the preferred method for fabricating the thermally printable thermoplastic media of the present invention comprises mixing all of the components of the thermally printable thermoplastic media and then preparing either a blown film or cast film under a nitrogen blanket. The components of the thermally printable thermoplastic media are preferably mixed according to the proportions disclosed in U.S. Pat. No. 5,474,968. The actual component amounts will vary depending on the film thickness desired.

Preferably, the films are produced having a thickness of from about 0.5 to 6.0 mils, even more preferably 0.5 to 1.5 mils, that is, approximately ⅓ the thickness of prior art printable paper and plastic. This leads to significant savings because the thinner printable media reduces the number of times the sales receipt tape needs to be changed in use and reduces transportation costs since the media rolls of the present invention are of similar weight and size to prior art rolls but contain up to three times the quantity of receipt media.

A variety of modifications can be made to the printable media of the present invention. For example, a multi-layer printable media can be provided which includes a layer of conventional thermoplastic material in addition to the thermally printable thermoplastic material of the present invention. A coextrusion, incorporating several layers of thermoplastic material, allows a major reduction in the amount of the thermal composition used since only the surface layer needs to be thermal chromogenic.

The thermally printable thermoplastic media of the present invention is printable by the same printers that print the current paper and plastic tapes that are commonly used as receipts for the sale of goods. Moreover, no adjustments to the current printing equipment are required to print onto the thermally printable thermoplastic media of the present invention. The ability to use the thermally printable thermoplastic media of the present invention as a replacement for paper provides significantly improved efficiency by increasing the amount of receipt media contained on a standard roll and by eliminating the separate coating steps typically utilized in thermal media. In addition, the present invention makes a tremendous contribution to the recyclability of plastic bags by eliminating the problems caused by paper receipts left in these bags.

The foregoing description of the invention has been provided for the purpose of illustration and description only and is not to be construed as limiting the invention in any way. The scope of the invention is to be determined from the claims appended hereto.

I claim:

1. A recyclable thermally printable thermoplastic media for recording printed data which can be recycled along with thermoplastic grocery bags comprising:

a recyclable thermoplastic material comprised of a layer of material which can be recycled along with thermoplastic grocery bags and a thermally activated composition incorporated therein for producing an irreversible color change in the presence of heat and oxygen, said thermally activated composition comprising a leuco-dye, a color developer, and a reaction promoter.

2. The thermally printable media according to claim 1 wherein said thermally activated composition further comprises a binder.

3. The thermally printable media according to claim 1 wherein said leuco-dye is selected from the group consisting of triphenylmethane dyes, fluoran dyes, phenothiazine dyes, rhodamine lactam dyes, and spiropyran dyes.

4. The thermally printable media according to claim 1 wherein said color developer comprises bisphenol A.

5. The thermally printable media according to claim 1 wherein said reaction promoter is selected from the group consisting of stearic acid amide, oleic acid amide, palmitic acid amide, sperm-whale oleic acid amide, and coconut fatty acid amide.

6. The thermally printable media according to claim 1 further comprising at least one non-printable recyclable thermoplastic material layer comprised of a material which can be recycled along with thermoplastic grocery bags.

7. The thermally printable media according to claim 1 wherein said thermally printable media has a thickness of about 0.5 to 6.0 mils.

8. The thermally printable media according to claim 7 wherein said printable media has a thickness of from about 0.5 to about 1.5 mils.

9. The thermally printable media according to claim 1 wherein said recyclable thermoplastic material is comprised of a material which can be recycled along with thermoplastic grocery bags selected from the group consisting of polyethylene, polypropylene, polystyrene and mixtures thereof.

10. A method of producing a recyclable thermally printable media comprising:

combining a recyclable thermoplastic material comprised of a layer of material which can be recycled along with thermoplastic grocery bags and a thermally activated composition for producing an irreversible color change in the presence of heat and oxygen, the composition comprising a leuco-dye, a color developer, and a reaction promoter;

melting the combined thermoplastic material and thermally activated composition; and forming a film from the combined thermoplastic material and thermally activated composition to produce a recyclable thermally printable media.

11. The method according to claim 10 wherein said step of forming is performed in an oxygen-free environment.

12. The method according to claim 10 wherein said step of forming is performed by extrusion.

13. A thermally printable media produced by the method of claim 10.

14. The thermally printable media according to claim 13 wherein said thermally activated composition further comprises a binder.

15. The thermally printable media according to claim 13 wherein said recyclable thermoplastic material is selected from the group consisting of polyethylene and polypropylene.

16. A recyclable thermally printable media for recording printed data comprising:

a recyclable thermoplastic material comprised of a layer of material which can be recycled along with thermoplastic grocery bags selected from the group consisting of polyethylene, polypropylene, polystyrene and mixtures thereof and a thermally activated composition incorporated therein, said thermally activated composition comprising a leuco-dye, a color developer, and a reaction promoter.

17. The thermally printable media according to claim 16 wherein said printable media has a thickness of about 0.5 to 6.0 mils wherein said printable media has a thickness of about 0.5 to 6.0 mils.

18. The thermally printable media according to claim 16 further comprising at least one non-printable recyclable thermoplastic material layer.

* * * * *